US008043870B2

(12) United States Patent
Manens et al.

(10) Patent No.: US 8,043,870 B2
(45) Date of Patent: Oct. 25, 2011

(54) CMP PAD THICKNESS AND PROFILE MONITORING SYSTEM

(75) Inventors: Antoine P. Manens, Sunnyvale, CA (US); Wei-Yung Hsu, Santa Clara, CA (US); Hichem M'Saad, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 82 days.

(21) Appl. No.: 12/437,897

(22) Filed: May 8, 2009

(65) Prior Publication Data

US 2009/0280580 A1 Nov. 12, 2009

Related U.S. Application Data

(60) Provisional application No. 61/051,634, filed on May 8, 2008.

(51) Int. Cl.
*H01L 21/00* (2006.01)

(52) U.S. Cl. ..... 438/7; 438/14; 438/692; 257/E21.528; 257/E21.583; 451/5; 451/6; 451/8; 451/11; 451/21

(58) Field of Classification Search ..... 438/7, 692, 438/14; 257/E21.528, E21.583; 451/5, 6, 451/8, 11, 21

See application file for complete search history.

(56) References Cited

U.S. PATENT DOCUMENTS

| | | | | |
|---|---|---|---|---|
| 5,974,679 | A | 11/1999 | Birang et al. | |
| 6,040,244 | A | 3/2000 | Arai et al. | |
| 6,045,434 | A | 4/2000 | Fisher, Jr. et al. | |
| 6,186,864 | B1 | 2/2001 | Fisher, Jr. et al. | |
| 6,517,414 | B1 * | 2/2003 | Tobin et al. | 451/8 |
| 6,616,513 | B1 | 9/2003 | Osterheld | |
| 6,661,224 | B1 | 12/2003 | Linder | |
| 6,872,132 | B2 | 3/2005 | Elledge et al. | |
| 7,070,479 | B2 | 7/2006 | Faustmann et al. | |
| 2003/0123067 | A1 | 7/2003 | Chuang | |
| 2004/0033761 | A1 * | 2/2004 | Ono et al. | 451/8 |
| 2007/0015442 | A1 * | 1/2007 | Shin | 451/8 |

OTHER PUBLICATIONS

International Search Report and Written Opinion dated Dec. 28, 2009 for International Application No. PCT/US2009/043288.

* cited by examiner

*Primary Examiner* — Matthew Smith
*Assistant Examiner* — Wilner Jean Baptiste
(74) *Attorney, Agent, or Firm* — Patterson & Sheridan, L.L.P.

(57) ABSTRACT

In one embodiment a method is provided for maintaining a substrate processing surface. The method generally includes performing a set of measurements on the substrate processing surface, wherein the set of measurements are taken using a displacement sensor coupled to a processing surface conditioning arm, determining a processing surface profile based on the set of measurements, comparing the processing surface profile to a minimum profile threshold, and communicating a result of the profile comparison.

20 Claims, 5 Drawing Sheets

CMP PAD THICKNESS AND PROFILE MONITORING SYSTEM

CROSS-REFERENCE TO RELATED APPLICATIONS

This application claims benefit of U.S. provisional patent application Ser. No. 61/051,634, filed May 8, 2008, which is herein incorporated by reference in its entirety.

BACKGROUND OF THE INVENTION

1. Field of the Invention

Embodiments of the invention generally relate to removing material from a substrate. More particularly, embodiments of the invention relate to polishing or planarizing a substrate by electrochemical mechanical polishing.

2. Description of the Related Art

In the manufacture of integrated circuits, layers of conductive material are sequentially deposited on a semiconductor wafer and removed to produce a desired circuit on the wafer.

Chemical Mechanical Processing (CMP) is a technique used to remove conductive materials from a semiconductor wafer or substrate surface by chemical dissolution while concurrently polishing the substrate with downforce and mechanical abrasion. Electrochemical Mechanical Processing (ECMP) is a recently developed variation of CMP which implements an electrochemical dissolution while concurrently polishing the substrate with a reduced downforce. Electrochemical dissolution is typically performed by applying a bias to the substrate surface performing as an anode, and applying a bias to a cathode to remove conductive materials from the substrate surface into a surrounding electrolyte. The bias may be applied to the substrate surface by a conductive material disposed on, or a conductive contact disposed on or through, a polishing material upon which the substrate is processed. The polishing material may be, for example, a processing pad disposed on a platen. A mechanical component of the polishing process is performed by providing relative motion between the substrate and the polishing material that enhances the removal of the conductive material from the substrate. ECMP stations may generally be adapted for deposition of conductive material on the substrate by reversing the polarity of the bias applied between the substrate and an electrode.

The substrate typically begins the planarization process having bulk conductive material deposited thereon in a non-planar orientation, which may be removed by one or more CMP, ECMP, or combination CMP/ECMP processes. When more than one process is utilized, the bulk removal is designed to produce a high removal rate and produce a substrate surface that is substantially planar before going to the next process (e.g., residual removal). In some processes, various chemistries have been developed to promote a higher removal rate of conductive material with lower downforce applied to the substrate. For example, passivation chemistry promotes a higher removal rate on raised areas of the substrate surface by passivating the conductive material on recessed areas of the substrate, thereby producing a more planar surface after the bulk removal process.

The processing pad performing bulk and residual removal must have the appropriate mechanical properties for substrate planarization while minimizing the generation of defects in the substrate during polishing. Such defects may be scratches in the substrate surface caused by raised areas of the pad or by polishing by-products disposed on the surface of the pad, such as accumulation of conductive material removed from the substrate precipitating out of the electrolyte solution, abraded portions of the pad, agglomerations of abrasive particles from a polishing slurry, and the like. The polishing potential of the processing pad generally decreases during polishing due to wear and/or accumulation of polishing by-products on the pad surface, resulting in sub-optimum polishing qualities.

SUMMARY OF THE INVENTION

In one embodiment a method is provided for maintaining a semiconductor substrate processing surface. The method generally includes performing a first set of measurements on the semiconductor substrate processing surface, wherein the set of measurements are taken using a displacement sensor coupled to a processing surface conditioning arm, determining a processing surface profile based on the set of measurements, comparing the processing surface profile to a "minimum profile threshold" or "reference profile", and communicating a result of the profile comparison.

In one embodiment an apparatus is provided for maintaining a semiconductor substrate processing surface. The apparatus generally includes a semiconductor substrate processing surface for removing material from the semiconductor substrate, a conditioning head for restoring polishing performance of the semiconductor substrate processing surface, a conditioning arm for positioning the conditioning head in contact with the semiconductor substrate processing surface, and a displacement sensor coupled to the conditioning arm. The displacement sensor may be configured to perform a set of measurements on the semiconductor substrate processing surface, determine a processing surface profile based on the set of measurements, compare the processing surface profile to a minimum profile threshold and communicate a result of the profile comparison.

In one embodiment a system is provided for maintaining a semiconductor substrate processing surface. The system generally includes a semiconductor substrate processing surface for removing material from the semiconductor substrate, a conductive platen for rotating the semiconductor substrate processing surface, a conditioning head for restoring polishing performance of the semiconductor substrate processing surface, a conditioning arm for positioning the conditioning head in contact with the semiconductor substrate processing surface, and a displacement sensor coupled to the conditioning arm.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
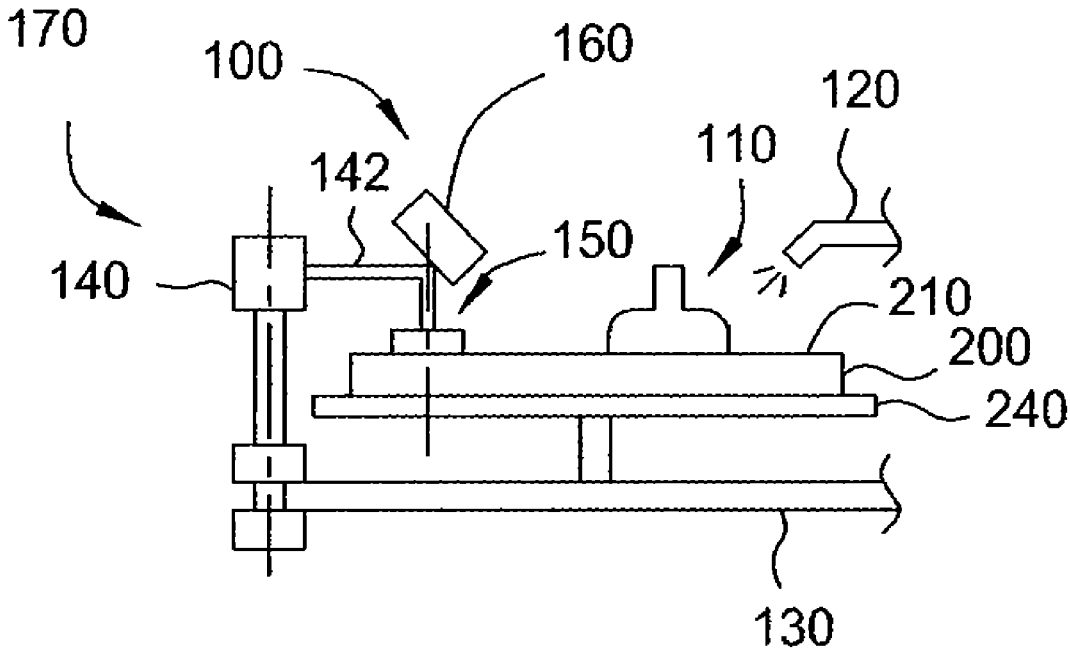
FIG. 1 is one embodiment of a ECMP processing system.

Embodiments of the invention generally relate to polishing or planarizing processes performed in the production of semiconductor substrates. Electrochemical Mechanical Planarization (ECMP) is one of the polishing processes described and broadly includes removal of previously deposited material from the semiconductor surface by a combination of mechanical, chemical and/or electrochemical forces. The mechanical force may include, but is not limited to, physical contact or rubbing action, and the chemical and/or electrical forces may include, but are not limited to, removal of material by anodic dissolution.

The substrate typically begins the planarization process having bulk conductive material deposited thereon in a non-planar orientation, portions of which may be removed by one or more ECMP processes in an effort to achieve a planar orientation. The processing pad performing this bulk removal must have the appropriate mechanical properties (e.g., magnitude and structure of surface asperities) for substrate planarization while minimizing the generation of defects in the substrate during polishing. The polishing potential of the processing pad generally decreases during polishing due to wear and/or accumulation of polishing by-products on the pad surface, resulting in sub-optimum polishing qualities. This sub-optimization of the polishing pad may occur in a non-uniform or localized pattern across the pad surface, which may promote uneven planarization of the conductive material. Thus, the pad surface must periodically be refreshed, or conditioned, to restore the polishing performance of the pad.

Since the decrease of the polishing potential of the pad may occur non-uniformly on the pad surface, a pad conditioning regime is typically implemented in a uniform manner across the pad surface. This uniform conditioning regime generally conditions the pad indiscriminately, which may result in an improvement of the polishing potential of the pad. However, the uniform pad conditioning regime neither accounts for areas of the pad exhibiting a localized loss in the polishing potential, nor areas of the pad that exhibit little or no decrease in polishing potential. Thus, optimum conditions may be maintained on portions of the pad where little or no decrease in polishing potential occurred, while localized portions where there is a higher decrease in polishing potential may remain sub-optimum.

To minimize the occurrence of localized portions of the pad with sub-optimum polishing potential, the processing pad may be monitored and the thickness of the pad at various locations may be measured. Embodiments of the present invention may incorporate a displacement sensor coupled to a processing pad conditioning arm to measure the processing pad thickness at various locations. By mounting the displacement sensor to the conditioning arm, the processing pad thickness may be monitored during a portion of a normal operation cycle resulting in a decreased downtime of an ECMP station.

An Exemplary System

FIG. 1 is a schematic side view of a polishing station 100 of an ECMP system. For example, the ECMP station could be an Applied Materials Reflexion LK ECMP™ or similar apparatus by another manufacturer. The polishing station 100 generally includes a conditioning apparatus 170 and a platen 240 rotated by a motor (not shown). The pad assembly 200 is disposed on the upper surface of the platen 240 such that a conductive processing surface 210 defines the processing surface of the polishing station 100. A carrier head 110 is disposed above the pad assembly 200 and is adapted to hold a substrate against the pad assembly 200 during processing. The carrier head 110 may impart a portion of the relative motion provided between the substrate and the pad assembly 200 during processing. In one embodiment, the carrier head 110 may be a TITAN HEAD™ or TITAN PROFILER™ wafer carrier available from Applied Materials, Inc., of Santa Clara, Calif. A processing fluid, such as an electrolyte, may be provided to the processing surface 210 of the pad assembly 200 by a nozzle 120 coupled to a processing fluid source (not shown).

In one embodiment, the conditioning apparatus 170 comprises a displacement sensor 160 coupled to a conditioning head 150 or conditioning disk supported by a support assembly 140 with a conditioning arm 142 therebetween. In one embodiment, the displacement sensor 160 is coupled with the conditioning arm 142. The support assembly 140 is coupled to the base 130 and is adapted, via the conditioning arm 142, to position the conditioning head 150 in contact with the pad assembly 200, and further is adapted to provide a relative motion therebetween. As a result of the relative motion of the conditioning head 150 with respect to the pad assembly 200, the displacement sensor 160 may take thickness measurements of the processing surface 210.

The conditioning head 150 is also configured to provide a controllable pressure or downforce to controllably press the conditioning head toward the pad assembly 200. The downforce pressure can be in a range between about 0.7 psi to about 2 psi. The conditioning head 150 generally rotates and/or moves laterally in a sweeping motion across the surface of the pad assembly 200 as indicated by arrows 350 and 342 in FIG. 3. In one embodiment, the lateral motion of the conditioning head 150 may be linear or along an arc in a range of about the center of the pad assembly 200 to about the outer edge of the pad assembly 200, such that, in combination with the rotation of the pad assembly 200, the entire surface of the pad assembly 200 may be conditioned. The conditioning head 150 may have a further range of motion to move the conditioning head 150 beyond the edge of the pad assembly 200 when not in use.

Note the polishing station 100 may be controlled by a controller (not shown). The controller may include hardware or software logic that receives feedback signals from the polishing station 100. The controller may generate and forward signals for a display based on the received feedback signals forward said information on to a display. The controller may also make and implement decisions regarding subsequent polishing station 100 operations based on the received feedback signals.

Figure 2:
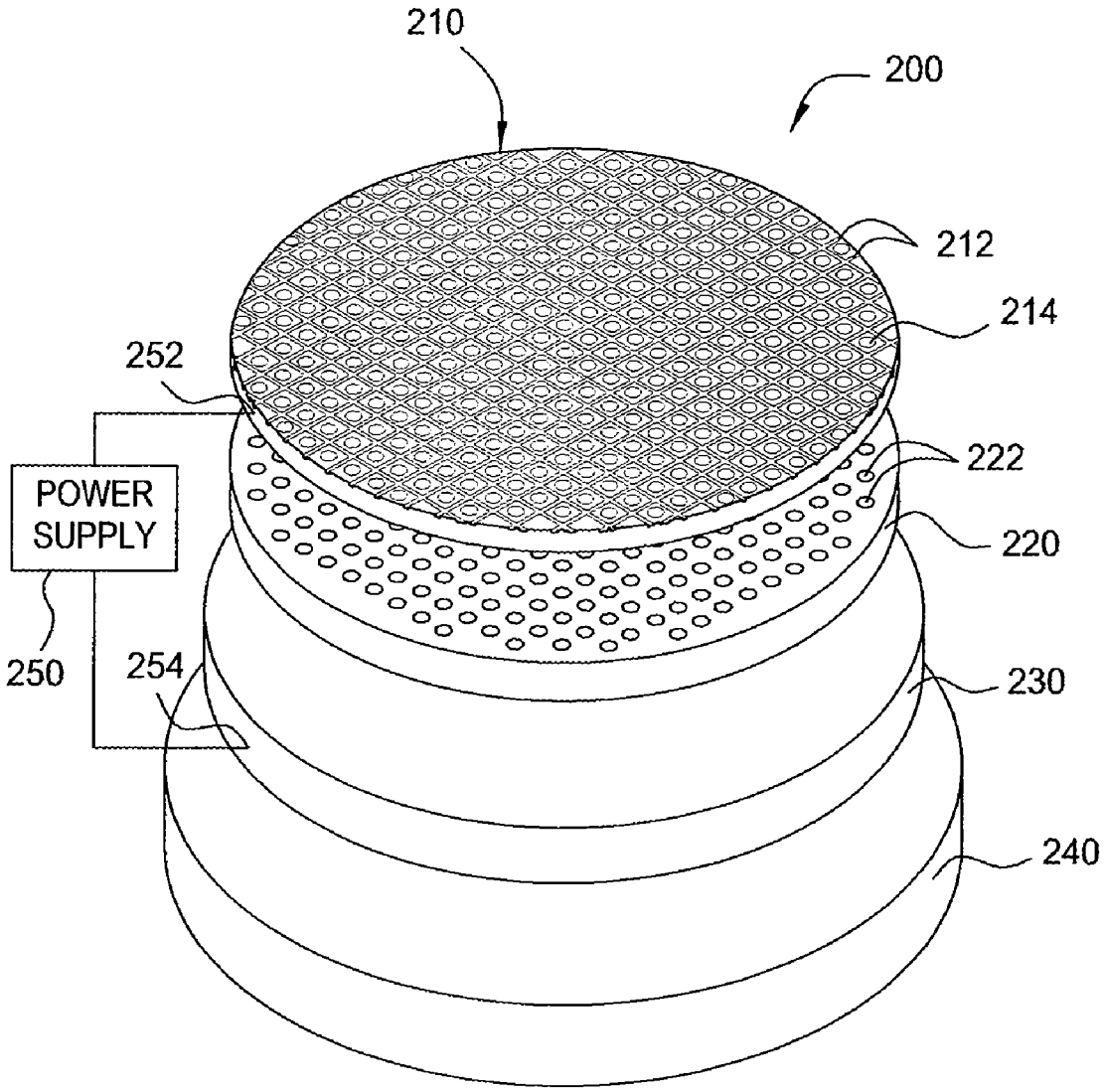
FIG. 2 is an exploded isometric view of one embodiment of a pad assembly.

FIG. 2 is an exploded isometric view of a pad assembly 200 having a conductive processing surface 210 disposed on an electrode 230, with a sub-pad 220 therebetween. In this embodiment, the conductive processing surface 210 defines the processing surface of the polishing station 100. The conductive processing surface 210 and the electrode 230 include at least one connector 252, 254, respectively, to couple the pad assembly 200 to opposing poles of a power source 250. The power source 250 is optional depending upon whether a CMP or ECMP process is performed. The sub-pad 220 provides enhanced compressibility to the conductive processing surface 210 and functions as an insulation element between the two conductive portions to allow the conductive processing surface 210 to act as an anode, and the electrode 230 to function as a cathode in the ECMP process. The electrode 230 may be a solid metal sheet, a foil, or mesh made of gold, tin, nickel, silver, stainless steel, derivatives thereof and combinations thereof. The various parts of the pad assembly 200 are typically coupled together by a process compatible adhesive, and is removably attached to an upper surface of a platen assembly 240, which is disposed within one or both of the polishing stations 100 of FIG. 1.

The conductive processing surface 210 may be made of a conductive material and/or comprise conductive particles bound in a polymer matrix. For example, conductive material may be dispersed integrally with or comprise the material comprising the processing surface 210, such as a polymer matrix having conductive particles dispersed therein and/or a conductive coated fabric, among others. The conductive particles may be particles of metal, such as gold, nickel, tin, zinc, copper, derivatives and combinations thereof. The conductive polymer may be disposed on a conductive carrier that may be a conductive foil or mesh. The conductive processing surface 210 may also include one or more apertures 214 that at least partially align with holes 222 in the sub-pad 220. The apertures 214 and the holes are adapted to be filled with an electrolyte to permit electrolytic communication between the electrode and the substrate surface when the conductive processing surface 210 is pressed against the conductive material on the substrate. Grooves or channels 212 may be formed on the conductive processing surface 210 to enhance electrolyte flow and retention, and provide a pathway for materials removed from the substrate to be flushed from the processing surface. Examples of pad assemblies may be found in U.S. Pat. No. 6,991,528, which issued Jan. 31, 2006, U.S. application Ser. No. 10/744,904, filed Dec. 23, 2003. Both the patent and application are hereby incorporated by reference to the extent the disclosures are not inconsistent with this application.

The polishing potential of the processing pad 200 generally decreases during polishing due to wear and/or accumulation of polishing by-products on the pad surface, resulting in sub-optimum polishing qualities. This wear of the polishing pad may occur in a non-uniform or localized pattern across the pad surface, which may promote uneven planarization of the conductive material. Thus, the pad surface must periodically be refreshed, or conditioned, to restore the polishing performance of the pad. This is done by the conditioning head 150.

Figure 3:
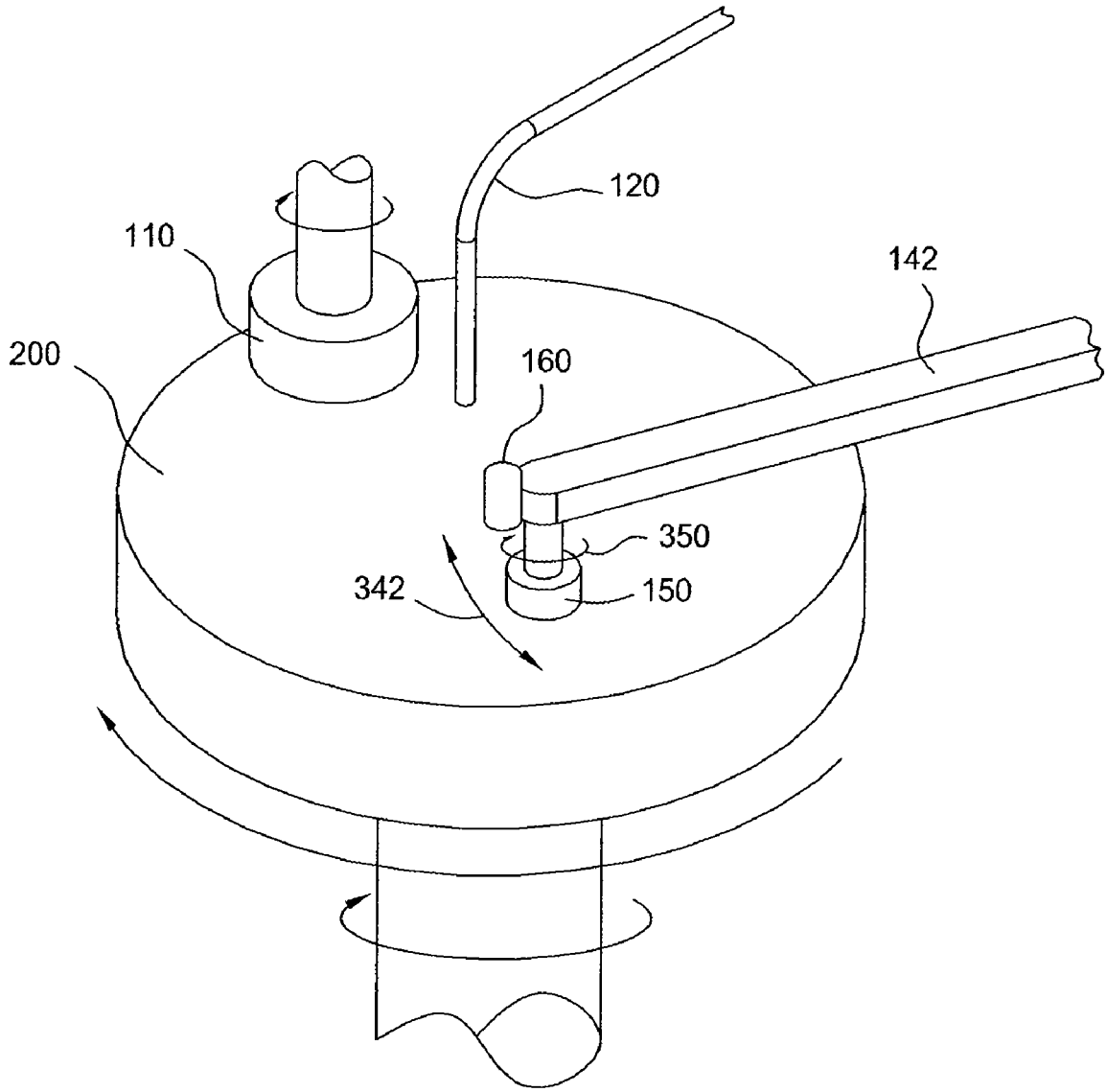
FIG. 3 is a schematic angled view of one embodiment of an ECMP station.

FIG. 3 is a schematic top view of a polishing station 100 of an ECMP system. The conditioning head 150 is shown coupled to the conditioning arm 142 and generally rotates and/or moves laterally in a sweeping motion across the surface of the pad assembly 200 to restore the polishing performance of the pad, as indicated by arrows 350 and 342. In one embodiment, the sweep range is from a perimeter portion of the pad to the center portion of the pad, i.e., the sweep range is a radial sweep range as the range enables conditioning of a radius of the pad. In other embodiments the sweep range is less than the radial sweep range by some fraction of one. In another embodiment, the sweep range may be greater than the radial sweep range.

As a result of repeated conditioning by the conditioning head 150, eventually the processing pad 200 needs to be replaced. However, due to the incoming tolerance of the pad, variation of wear rate from disk to disk, and variations from tool to tool (e.g., conditioning downforce calibration), a conservative approach is usually followed, and the life of the processing pad is not maximized.

Figure 4:
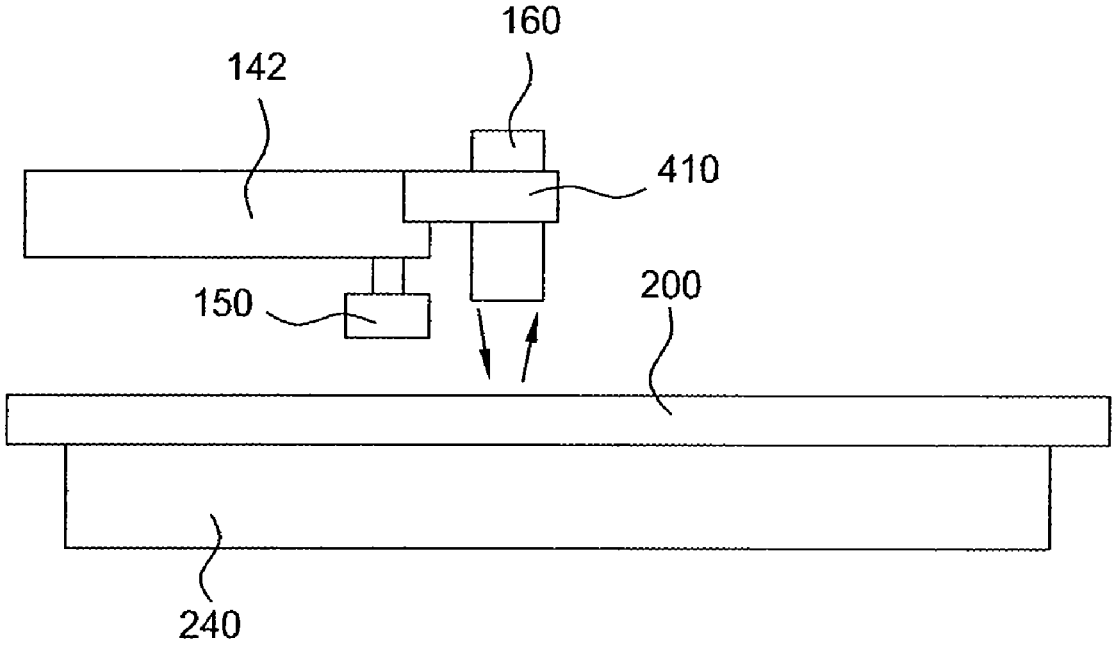
FIG. 4 is a schematic side view of an ECMP station with a displacement sensor mounted to a conditioning arm.

FIG. 4 illustrates embodiments of the invention in which a displacement sensor 160 is coupled to the conditioning arm 142 by means of a mounting apparatus 410. The sensor coupled to the conditioning arm allows a thickness of the processing pad 200 to be measured at various points during a portion of a normal operation cycle, while the accompanying logic allows the measurement data to be captured and displayed (e.g., generation of a two-dimensional map of the processing pad). In some embodiments, the sensor 160 may utilize a laser to measure the thickness of the pad. In other embodiments, the sensor 160 may be an inductive sensor.

In embodiments incorporating a laser based sensor 160, the thickness of the processing pad 200 is measured directly. The conditioning arm is in a fixed position with respect to the platen 240, and the laser 160 is in a fixed position with respect to the arm. Consequently, the laser 160 is in a fixed position with respect to the platen 240. By measuring the distance to the processing pad and calculating the difference between the distance to the processing pad 200 and the distance to the platen 240, the remaining thickness of the processing pad 200 may be determined. In some embodiments, the resolution of the thickness measurement using the laser based sensor 160 may be within 25 um.

In embodiments incorporating an inductive sensor 160, the thickness of the processing pad 200 is measured indirectly. The conditioning arm is actuated around a pivot point until the conditioning head 150 comes in contact with the processing pad 200. An inductive sensor, which emits an electromagnetic field, is mounted to the end of the pivot based conditioning arm. In accordance with Faraday's law of induction, the voltage in a closed loop is directly proportional to the change in the magnetic field per change in time. The stronger the applied magnetic field the greater the eddy currents developed and the greater the opposing field. A signal from the sensor is directly related to the distance from the tip of the sensor to the metallic platen 240. As the platen 240 rotates the conditioning head 150 rides on the surface of the pad and the inductive sensor rises and falls with the conditioning arm according to the profile of the processing pad 200. As the inductive sensor gets closer to the metallic platen 240, an indication of processing pad wear, the voltage of the signal increases. The signal from the sensor is processed and captures the variation in the thickness of the processing pad assembly 200. In some embodiments, the resolution of the thickness measurement using the inductive sensor 160 may be within 1 um.

Figure 5:
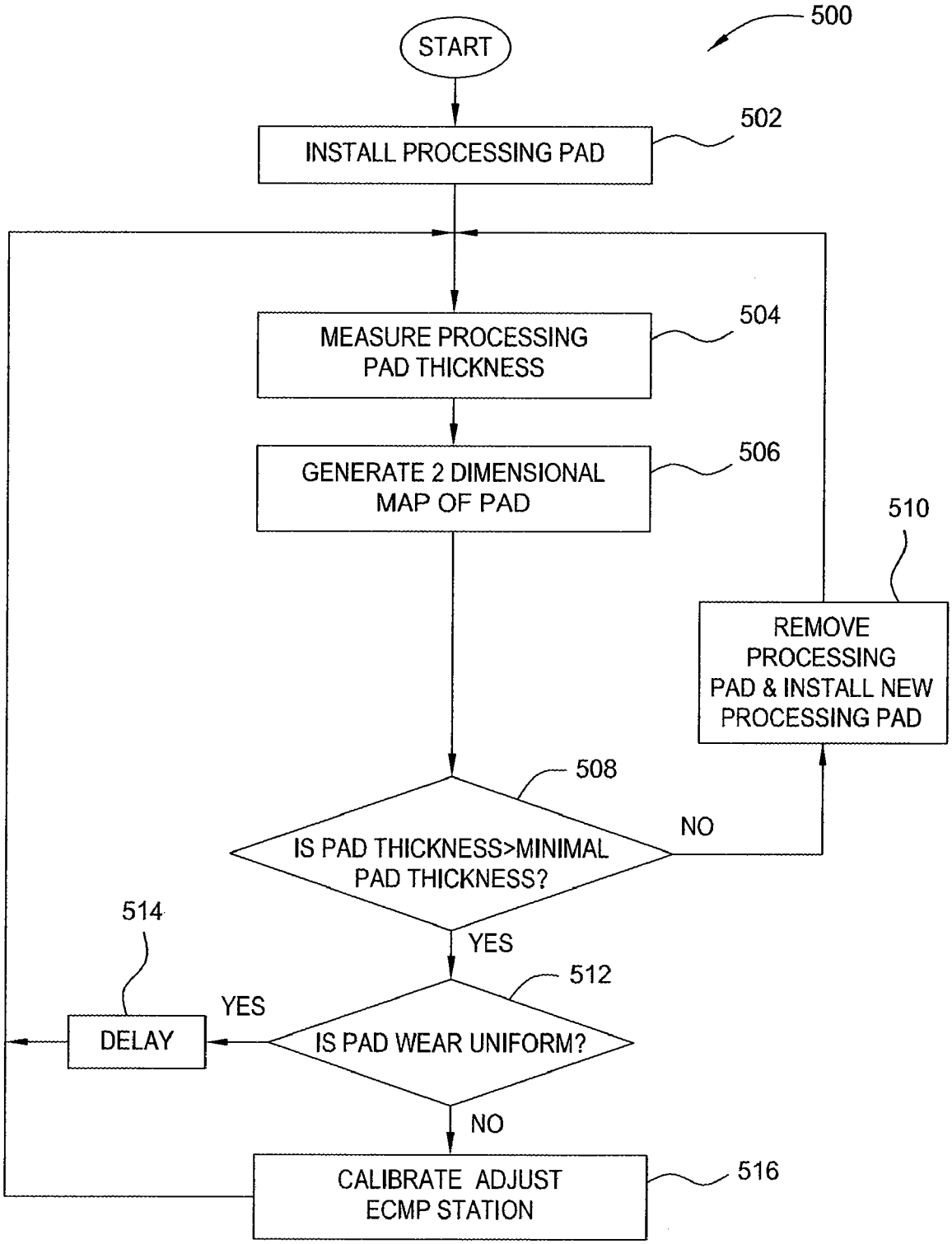
FIG. 5 is a flowchart of one embodiment of a polishing method.

FIG. 5 is one embodiment of a monitoring method 500 configured to measure and monitor an ECMP or CMP processing pad thickness and profile. The method starts at 502 with the installation of a processing pad 200. At 504, the sensor 160 attached to the conditioning arm 142 measures the thickness of the processing pad at various points. At 506, the thickness of the processing pad 200 at different points is utilized to generate a processing surface profile. In one embodiment, the processing surface profile is a two dimensional map of the processing pad.

At 508, a comparison is made between the pad thickness as measured at the various points and the minimal allowable pad thickness or the "minimum profile threshold." Note that the minimal allowable pad thickness may be specified by an operator, based on a percentage of the original thickness or specified by any other means known to one skilled in the art.

If the pad thickness is not greater than the minimal allowable pad thickness, then, the processing pad may be removed and disposed of, having reached the end of its useful life, and a new processing pad may be installed, as illustrated at 510.

After a processing pad is worn below the minimal allowable pad thickness, the pad may need to be replaced because the processing pad may be too thin to restore the polishing performance. After replacement of the processing pad at 510, operations 504-508 may be repeated and the new processing pad may be measured.

However, if the thickness of the processing pad is greater than the minimal allowable thickness, then, at 512, the 2 dimensional map of the pad is examined to ensure the processing pad is wearing in a uniformed fashion. By monitoring the uniformity of the processing pad, adjustments may be made in a timely manner effectively extending the useable lifetime of the pad resulting in decreased downtime of the ECMP station. For example, if the processing pad is wearing in a non-uniform manner, the orientation of the conditioning head or conditioning arm may be modified to alter the distribution of pressure from the conditioning head along the processing pad. Further, the controller logic may be altered to modify conditioning arm operations possibly reducing localized non-uniformities.

If the processing pad wear is uniform, then, at 514, there is a delay in which standard ECMP processes are performed prior to additional processing pad measurements being taken. Note the length of the delay may designated by an operator, dependent on the occurrence of an event, or specified by any other means known by someone skilled in the art. The delay is the time during which normal operations occur prior to operations 504-512 being repeated.

If the processing pad does not wear in a uniform fashion, then, at 516, the processing pad 200 is adjusted. In some embodiments, operations 504-512 may be repeated immediately following adjustment of the processing pad. This may limit or prevent incorrect pad adjustments from harming subsequently processed substrates.

In some embodiments, sweep frequency of the conditioning head and conditioning element may be adjusted. The sweep frequency may be adjusted to condition portions of the processing surface of the pad more aggressively on portions of the processing surface where localized loss of polishing potential is determined. For example, the sweep frequency could be based in part on the rotational speed of a circular conductive pad. In this example, the geometry and RPM of the pad may necessitate a higher or lower sweep frequency based on the profile determination and areas of contact between the substrate and the conductive pad. In one embodiment, the sweep frequency may be between about 5 sweeps/minute to about 20 sweeps/minute, for example between about 8 sweeps/minute to about 14 sweeps/minute, such as about 10 sweeps/minute.

In another embodiment, the sweep range may be adjusted by varying the sweep range across the processing surface of a circular conductive pad. For example, the center of a circular conductive pad may be prone to a greater localized loss of polishing potential relative to the perimeter of the circular conductive pad, thus inhibiting planarization in the center portion. In this instance, the sweep range may be varied from a full radial sweep to a three quarter sweep wherein the sweep range conditions from about the center of the pad to about three-quarters of the radius from the center. In this example, the remaining quarter of the radius of the pad will not be conditioned. A three quarter sweep may be used inversely if the perimeter of the circular pad exhibits decreased planarization potential relative to the center portion, thus conditioning the perimeter and not conditioning a portion of the pad near the center of the pad. The sweep range adjustment is not limited to the fraction described and may be any fraction depending on conditioning needs of the pad.

Other embodiments may combine a sweep range adjustment with the rotational motion of the pad, wherein the sweep range is a fractional range for any number of pad revolutions. The sweep range may be fractional for a desired integer of pad RPM and then a full sweep range is resumed for another desired integer of pad RPM. For example, if a greater localized loss of polishing potential is determined on the perimeter of the pad relative to the center, the center may need less conditioning than the perimeter. Thus, a half-sweep could be implemented between the perimeter of the pad and approximately half of the radius from the perimeter. This half-sweep may continue, for example, for about 5 to 10 revolutions of the pad. At every sixth or eleventh revolution, respectively, a full sweep may be resumed to condition the half radius of the pad in the center. The full sweep may be continued for any desired integer of pad RPM and the half-sweep may be resumed.

Conditioning element RPM may be adjusted to provide enhanced conditioning to various portions of the processing surface of a conductive polishing pad. In one embodiment, the conditioning element RPM may be set at some static RPM during conditioning. In one embodiment, the conditioning element RPM is between about 30 RPM to about 100 RPM, for example, between about 40 RPM to about 70 RPM. In other embodiments, the conditioning parameters may be adjusted as described above, and the conditioning element RPM may be varied. For example, the conditioning element RPM may be increased when the conditioning head is conditioning the perimeter portion of the pad, and decreased when conditioning the center portion. In this embodiment, the perimeter may be conditioned more aggressively than the center portion. If the center portion needs more aggressive conditioning than the perimeter portion, the conditioning element RPM could be higher when conditioning the center relative to the perimeter.

Conditioning head downforce may also be adjusted. In one embodiment, the downforce applied to the conditioning element relative the pad is static in a range between about 0.7 psi to about 2.0 psi, for example between about 1.0 psi to about 1.7 psi. In other embodiments, the conditioning parameters may be adjusted as described above, and the downforce may be varied. For example, the downforce may be increased when the conditioning head is conditioning the perimeter portion of the processing surface of the pad, and decreased when conditioning the processing surface of the center portion. In this embodiment, the perimeter may be conditioned more aggressively than the center portion. If the center portion needs more aggressive conditioning than the perimeter portion, the downforce could be higher when conditioning the center relative to the perimeter.

While the conditioning methods disclosed herein have been exemplarily described conditioning a conductive pad, the invention is not limited to conductive pads as the processing surface of non-conductive pads may benefit from the conditioning method. Further, as the methods disclosed herein have been exemplarily described with a circular pad, the invention is not limited to this disclosure and may be used for example, on a linear polishing system, such as an endless belt, an apparatus using a pad configured to advance across a platen from a supply roll to a take up roll, or any apparatus for polishing substrates using a polishing pad. Other and further embodiments of the invention may be devised without departing from the basic scope thereof, and the scope thereof is determined by the claims that follow.

The invention claimed is:

1. A method of maintaining a substrate processing surface of a processing pad positioned on a platen, comprising:

performing a first set of measurements on the substrate processing surface, wherein the first set of measurements are taken using a displacement sensor coupled to a processing surface conditioning arm, wherein the conditioning arm is coupled with a conditioning head located separate from a carrier head adapted to hold a substrate against the substrate processing surface;

determining a processing surface profile based on the first set of measurements;

comparing the processing surface profile to a minimum profile threshold; and communicating a result of the profile comparison, wherein communicating a result includes sending a feedback signal which conveys the result of the profile comparison.

2. The method of claim 1, further comprising evaluating if the substrate processing surface wear is uniform.

3. The method of claim 2, wherein evaluating if the substrate processing surface wear is uniform is performed if the processing surface profile meets the minimum profile threshold.

4. The method of claim 2, further comprising, communicating the results of the uniform wear evaluation.

5. The method of claim 2, further comprising, performing a second set of measurements on the substrate processing surface, wherein the second set of measurements are taken using the displacement sensor.

6. The method of claim 2, further comprising, adjusting the substrate processing surface; and performing a second set of measurements on the substrate processing surface, wherein the second set of measurements are taken using the displacement sensor.

7. The method of claim 4, wherein communicating the results of the uniform wear evaluation comprises generating an error message if the processing surface wear is not uniform.

8. The method of claim 1, wherein communicating a result of the profile comparison comprises generating an error message if the processing surface profile fails to meet the minimum profile threshold.

9. The method of claim 1, wherein the performing a first set of measurements comprises:

positioning the processing surface conditioning arm and displacement sensor in a fixed position with respect to the platen;

measuring the distance from the displacement sensor to the substrate processing surface of the processing pad; and calculating the difference between the distance to the processing surface of the processing pad and the distance to the platen.

10. The method of claim 1, wherein the performing a first set of measurements comprises:

actuating the processing surface conditioning arm around a pivot point until the conditioning head contacts the substrate processing surface of the polishing pad, wherein the displacement sensor is an inductive sensor mounted to an end of the conditioning arm;

rotating the platen and measuring a distance from a tip of the sensor to the platen;

generating a signal related to the distance from the tip of the sensor to the platen; and processing the signal to capture a variation in thickness of the processing pad.

11. The method of claim 10, wherein the platen is a metallic platen.

12. A substrate processing system, comprising:

a substrate processing surface of a processing pad for removing material from the substrate;

a platen for rotating the substrate processing surface;

a conditioning head for restoring polishing performance of the substrate processing surface;

a conditioning arm for positioning the conditioning head in contact with the substrate processing surface;

a displacement sensor coupled to the conditioning arm configured to perform a set of measurements on the substrate processing surface;

a carrier head disposed above the substrate processing surface and adapted to hold a substrate against the substrate processing surface; and logic, wherein the logic is configured to:

determine a processing surface profile based on the set of measurements; and compare the processing surface profile to a minimum profile threshold.

13. The system of claim 12, wherein the conditioning head is configured to provide a controllable downforce pressure on the substrate processing surface.

14. The system of claim 13, wherein the controllable downforce pressure is in a range between 0.7 psi and 2 psi.

15. The system of claim 12, wherein the conditioning arm rotates laterally around a pivot point with respect to the substrate processing surface.

16. The system of claim 12, wherein the logic is further configured to:

evaluate if the processing surface wear is uniform; and communicate the results of the uniform wear evaluation.

17. The system of claim 16, wherein the logic is further configured to:

adjust the substrate processing surface, if the processing surface wear is not uniform;

calibrate the substrate processing surface, if the processing surface wear is not uniform; and perform another set of measurements on the substrate processing surface, wherein the set of measurements are taken using the displacement sensor coupled to the processing surface conditioning arm, if the processing surface wear is not uniform.

18. The system of claim 12, wherein the logic is further configured to perform a set of measurements by:

positioning the conditioning arm and displacement sensor in a fixed position with respect to the platen;

measuring the distance from the displacement sensor to the substrate processing surface of the processing pad; and calculating the difference between the distance to the processing surface of the processing pad and the distance to the platen.

19. The system of claim 12, wherein the logic is further configured to perform a set of measurements by:

actuating the processing surface conditioning arm around a pivot point until the conditioning head contacts the substrate processing surface, wherein the displacement sensor is an inductive sensor mounted to an end of the conditioning arm;

rotating the platen and measuring a distance from a tip of the sensor to the platen;

generating a signal related to the distance from the tip of the sensor to the platen; and processing the signal to capture a variation in thickness of the processing pad.

20. The method of claim 19, wherein the platen is a metallic platen.

* * * * *